US005325662A

United States Patent [19]

Varney et al.

[11] Patent Number: 5,325,662

[45] Date of Patent: Jul. 5, 1994

[54] ADVANCED EXHAUST DISCHARGE FOR PUMP JET PROPULSION APPARATUS

[75] Inventors: A. Michael Varney, Winter Park; John Martino, Longwood, both of Fla.; Kimball P. Hall, Poquott, N.Y.

[73] Assignee: Hall Marine Corporation, Poquott, N.Y.

[21] Appl. No.: 146,324

[22] Filed: Nov. 2, 1993

[51] Int. Cl.[5] ..... B63H 21/32

[52] U.S. Cl. ..... 60/221; 416/93 A; 440/89

[58] Field of Search ..... 60/221, 222; 416/93 R, 416/93 A; 440/89, 38, 47

[56] References Cited

U.S. PATENT DOCUMENTS

| | | | |
|---|---|---|---|
| 3,249,083 | 5/1966 | Irgens | 60/221 |
| 3,389,558 | 6/1968 | Hall . | |
| 3,849,982 | 11/1974 | Hall | 60/221 |
| 4,023,353 | 5/1977 | Hall | 60/221 |

FOREIGN PATENT DOCUMENTS

| | | | |
|---|---|---|---|
| 0119909 | 9/1980 | Japan | 440/89 |
| 1418636 | 12/1975 | United Kingdom | 440/47 |

*Primary Examiner*—Richard A. Bertsch
*Assistant Examiner*—W. J. Wicker
*Attorney, Agent, or Firm*—Mathews, Woodbridge & Collins

[57] ABSTRACT

An exhaust-through-the-hub system described herein includes an apparatus for discharge of exhaust gases from a marine outboard motor to the outer perimeter of an attached pump jet. Exhaust gas is ducted downwardly through the central body of the motor and rearwardly into a plenum cavity positioned in the pump jet. At least one hollow stator vane receives the exhaust gas and discharges the exhaust gas through the stator housing at a substantial depth below the water line, thereby resulting in a quieter running engine. The exhaust-through-the-hub system provides forward thrust when the motor is in forward gear and reverse thrust when the motor is in reverse gear.

10 Claims, 4 Drawing Sheets

ADVANCED EXHAUST DISCHARGE FOR PUMP JET PROPULSION APPARATUS

BACKGROUND OF THE INVENTION

Field of the Invention

This invention relates to an apparatus for directing the discharge of exhaust gases through the vanes in the housing of a marine pump jet.

Description of the Related Art

In conventional outboard motors, a propeller is driven by a powerhead to propel a boat through the water. Essentially all large size modern outboard motors inject the exhaust gas stream under water in order to reduce noise of the engine and increase propulsive thrust.

A typical configuration of a propeller driven by a power head is shown in FIG. 1. The exhaust of the motor flows from powerhead 10 downwardly through a hub exhaust channel 12. The exhaust rearwardly exits the motor through propeller 14. This type of motor is referred to as an exhaust-through-the-hub motor. Almost all motors of current manufacture are exhaust-through-the-hub types, including motors made by Evinrude and Johnson Motors, manufactured by Outboard Marine Corporation, Waukegan, Ill.; and Mercury Motors manufactured by the Brunswick Corporation.

U.S. Pat. No. 3,249,083 describes an outboard motor having a propeller positioned behind a gear case in which exhaust, originating in the outboard powerhead, is ducted downward through the central body of the motor and is discharged underwater behind the gear case. A passageway is formed in the hub of the outboard propeller for channelling the exhaust gas downstream. This system is an exhaust-through-the-hub system.

It is possible to replace the propeller with a pump jet system. In a pump jet system, the impeller is mounted directly on the propeller shaft instead of the propeller. A housing surrounds the impeller. Such a system has the advantages of reducing hazards to swimmers in the vicinity of the motor, protecting the rotor elements from interference and damage by foreign objects, and improving the efficiency and performance of the propulsion system.

An example of prior art of pump jet installed on downstream exhaust motor is shown in FIG. 2. That pump jet was invented by Dr. Kimball P. Hall, one of the inventors of the invention that is the subject of this disclosure. FIG. 2 illustrates a prior art pump jet 16 positioned below an anticavitation plate 18 and rearward of a lower unit housing 20. Pump jet 16 is composed primarily of a shroud 24 and a bladed rotary impeller 29. Impeller 29 is totally enclosed within shroud 24. Pump jet 16 is attached at the top to anticavitation plate 18 and at the bottom to the lower unit housing 20. Impeller 29 is attached to the rearwardly projecting propeller shaft 22 centrally located within shroud 24. Shroud 24 has a front section 26 and a rear section 28 that houses the bladed rotary impeller 29. A bearing support 30 engages an extension 23 at the rear end of the propeller shaft 22. Stator vanes 32, which are present to neutralize the swirl from the impeller, also serve to attach the bearing support 30 to the rear shroud section 28. At the rear end of the anticavitation plate 12 is a downwardly projecting exhaust gas outlet 34 which projects the exhaust gas into a channel 36 formed in the upper surface of the rear section 28. Since the exhaust stream does not flow through the central portion of the propeller, the system is not an exhaust-through-the-hub system. This prior art pump jet has the disadvantage that it cannot be used with an exhaust-through-the-hub motor.

U.S. Pat. No. 4,023,353 describes a pump jet mounted on an exhaust-through-the-hub outboard motor. This system was designed by Dr. Kimball P. Hall one of the inventors of this disclosure. The system discharges engine exhaust gas from the powerhead to a rotor. A circular duct positioned below the outer surface of the hub of the rotor receives the exhaust gas. Exhaust gases are discharged rearwardly through the rotor hub during forward drive and are radially discharged outwardly at a discharge location forward of the pump jet housing during reverse drive. This complex exhaust system design is necessary in order for the pump to generate reverse thrust when the rotor rotates in a reverse direction. However, this design results in high manufacturing costs.

SUMMARY OF THE INVENTION

Briefly described, the invention comprises an apparatus for directing the discharge of exhaust gases through the central portion of an outboard motor and through the stator vanes of an attached pump jet.

A pump jet is attached to the rear end of a marine outboard motor in place of a propeller. Exhaust gas is ducted downwardly through the central body of the motor and around a rotor shaft. An annular exhaust channel is preferably formed in the rotor hub for receiving the exhaust and projecting the gas rearwardly of the motor. A cavity in the stator hub provides a plenum chamber for receiving the exhaust gases. Exhaust gases flow from the cavity of the stator hub to at least one hollow stator vane which serves as an exhaust pipe. Preferably, discharge ports are formed in the stator housing for discharging under the water line the exhaust gas from the stator vane. The present invention provides an exhaust-through-the-hub system for a pump jet which provides forward thrust when the motor is in forward gear and reverse thrust when the motor is in reverse gear without the complication of redirecting the gas flow. The discharge of exhaust gases under the water line results in a quieter running engine.

DETAILED DESCRIPTION OF THE INVENTION

During the course of this description like numbers will be used to identify like elements according to the different figures which illustrate the invention.

Figure 1:
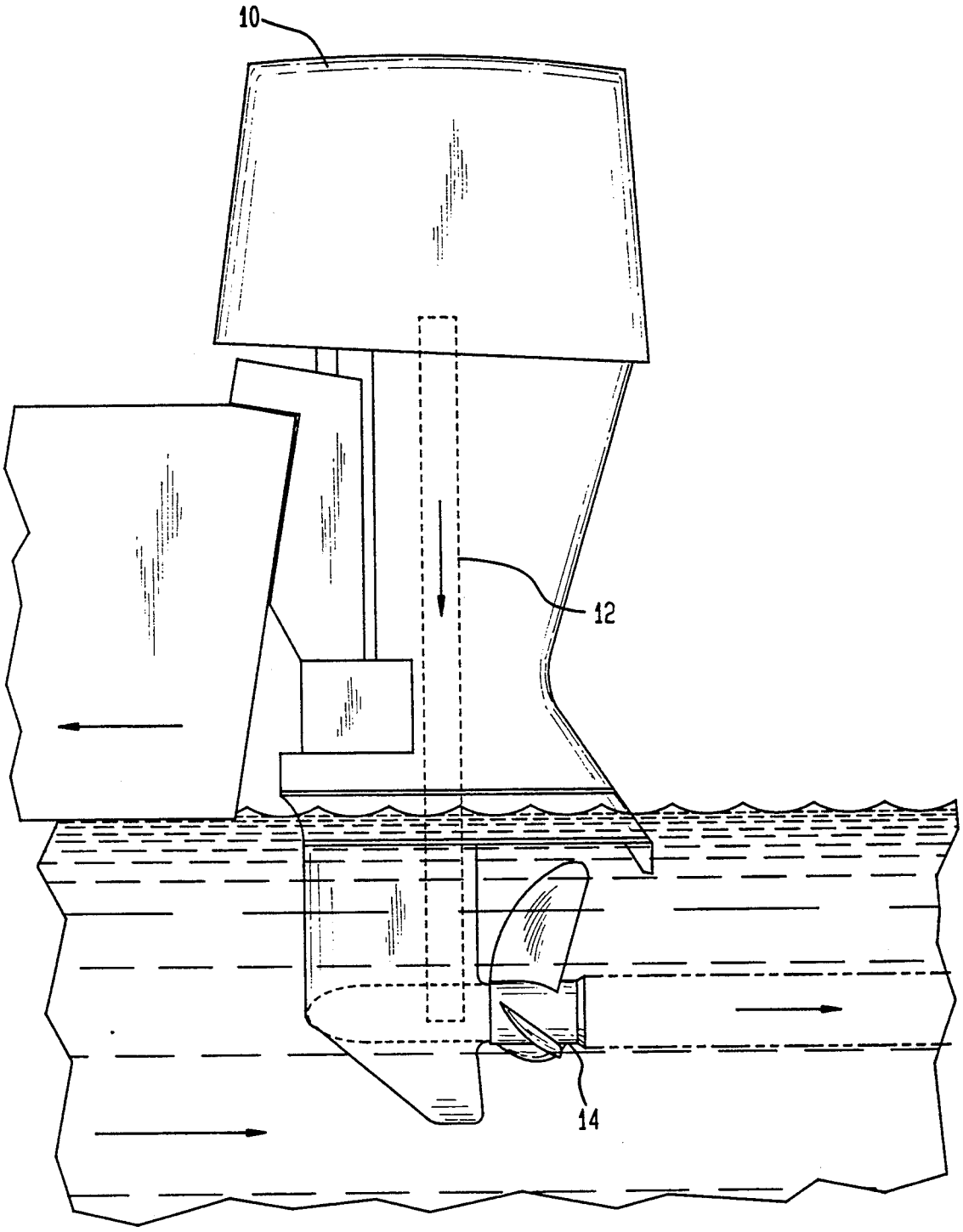
FIG. 1 (PRIOR ART)
FIG. 1 is a schematic view of a prior art exhaust-through the-hub motor with a propeller.
Figure 2:
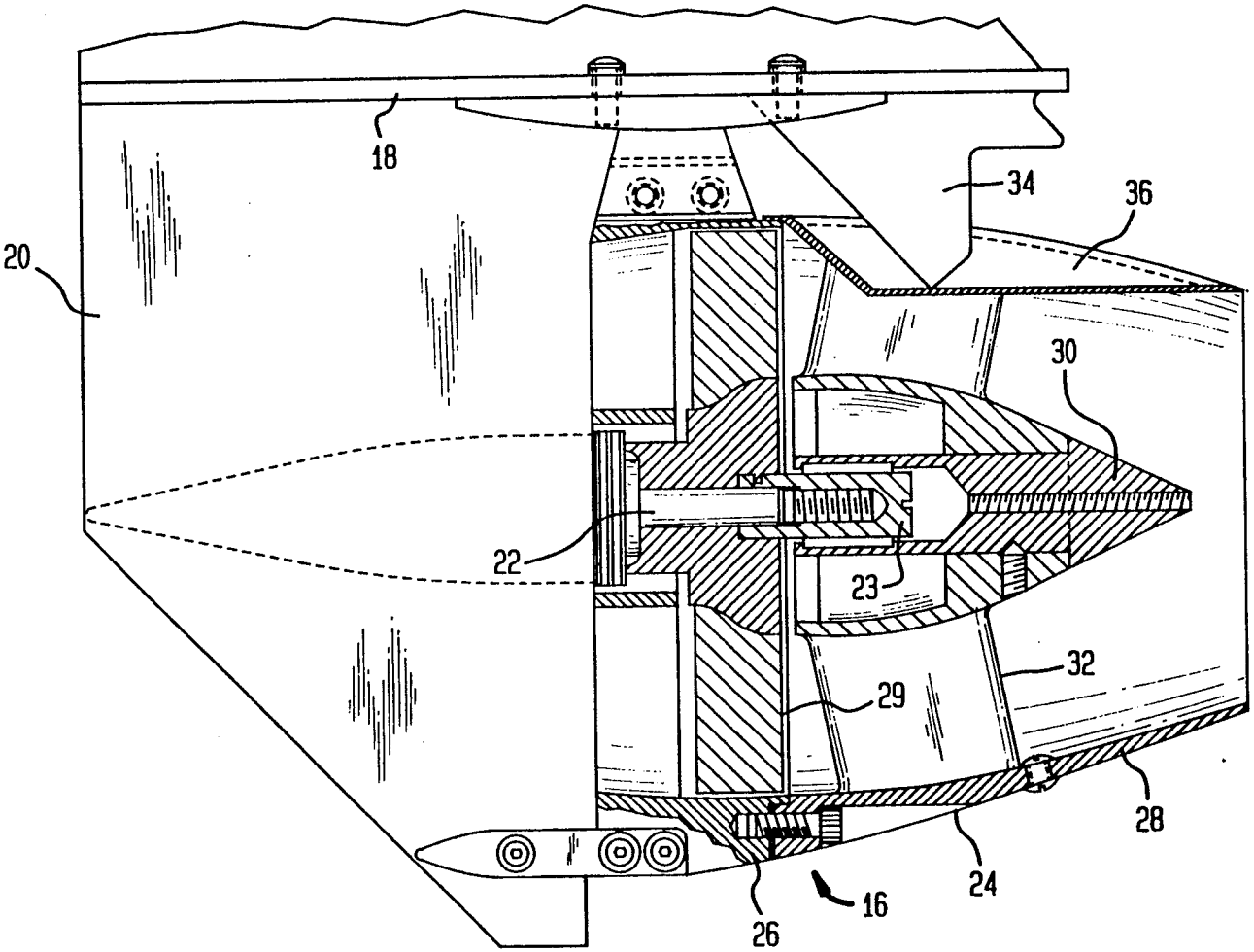
FIG. 2 (PRIOR ART)
FIG. 2 is a vertical cross-sectional view of a prior art downstream exhaust pump jet.
Figure 3:
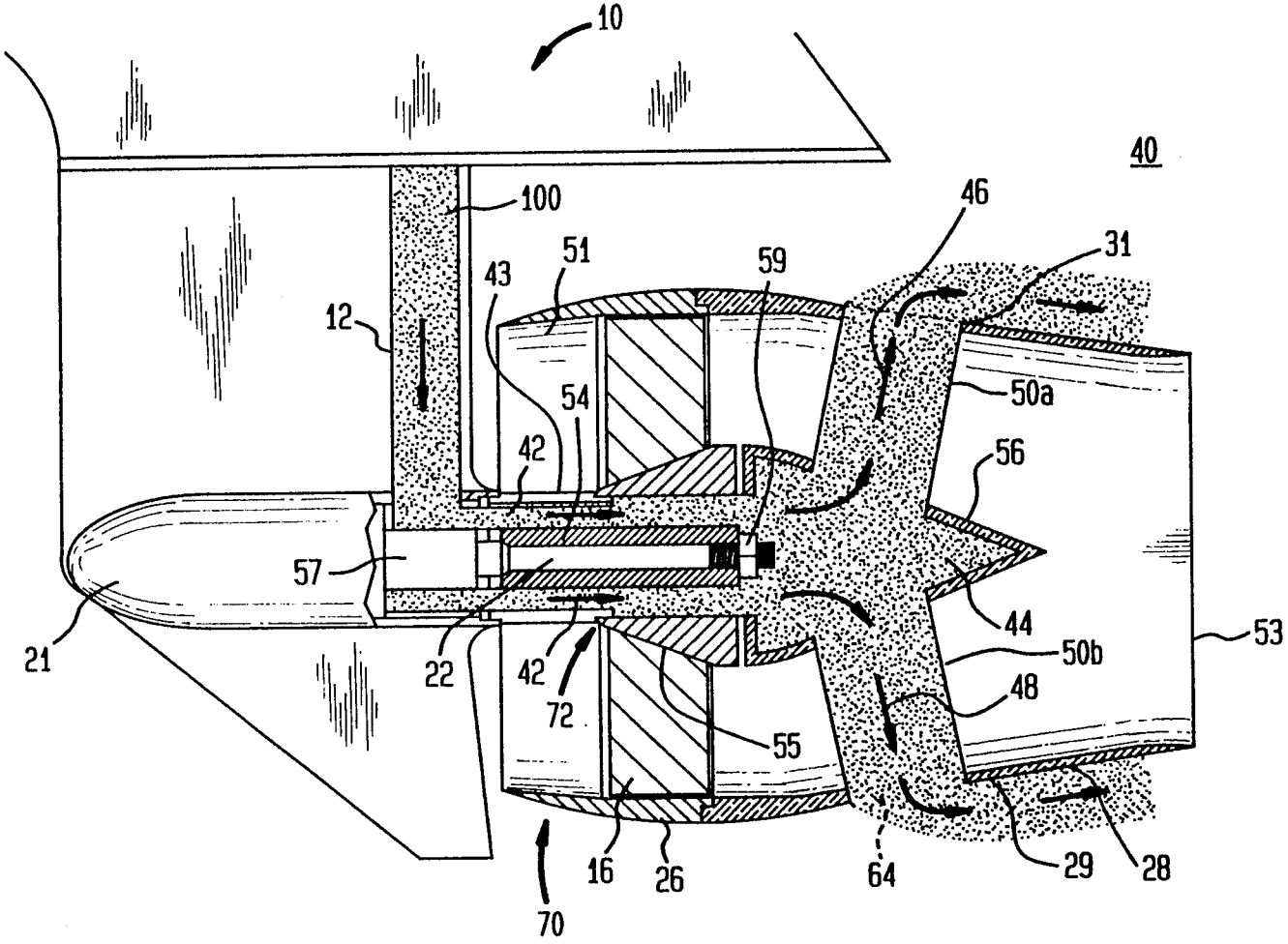
FIG. 3 is a schematic view of the preferred embodiment of the invention of an exhaust-through-the-hub motor having an exhaust stream discharged through at least one stator vane.

The preferred embodiment of an exhaust-through-the-hub system for a pump jet 40 includes a channel 42 for receiving exhaust gas through exhaust channel 12 from an exhaust-through-the hub marine motor 10, as shown in FIG. 3. Channel 42 is an annulus positioned within rotor housing 26. Inlet vanes 51 direct water flow into blades 16 attached to outer rotor hub 55. Blades 16 spin thereby imparting energy and momentum to the water flow passing through pump jet 40. Stator vanes 50*a*, 50*b* convert rotational energy imparted to the water flow above the rotor blades into axial flow energy at the exit end of stator housing 28. Examples of an acceptable outboard motor 10 are manufactured by Evinrude and Johnson ( subsidiaries of Outboard Marine Corporation, Waukegan, Ill.) and Mercury Marine, Inc. (a subsidiary of Brunswick Corporation). In an alternative embodiment, an inboard motor could be substituted for the outboard motor.

During operation of the motor, an exhaust stream 100 flows downwardly from power head 10 through the central body of the motor in an exhaust duct 12. Exhaust stream 100 is channelled rearwardly in channel 42 around propeller shaft 22. Preferably, channel 42 is an annulus bounded internally by propeller shaft bearing housing 57 and inner rotor hub 54 and externally by the gear case wall, inlet vane hub 43 and outer rotor hub 55. Exhaust stream 100 flows from channel 42 to plenum cavity 44 formed in stator hub 56. Stator vanes 50*a*, 50*b* extend between stator hub 56 to stator housing 28. At least one of stator vanes 50*a*, 50*b* is hollow and communicates with plenum cavity 44. In a preferred embodiment, stator vane 50*b* is hollow and extends downwardly to the bottom surface 29 of stator housing 28. In the alternative, stator vane 50*a* is hollow and extends upwardly to the top surface 31 of stator housing 28 or both stator vanes 50*a* and 50*b* are hollow. Preferably, exhaust stream 100 flows from the hollow stator vane to exit stator housing 28 through exhaust port 64.

Figure 4:
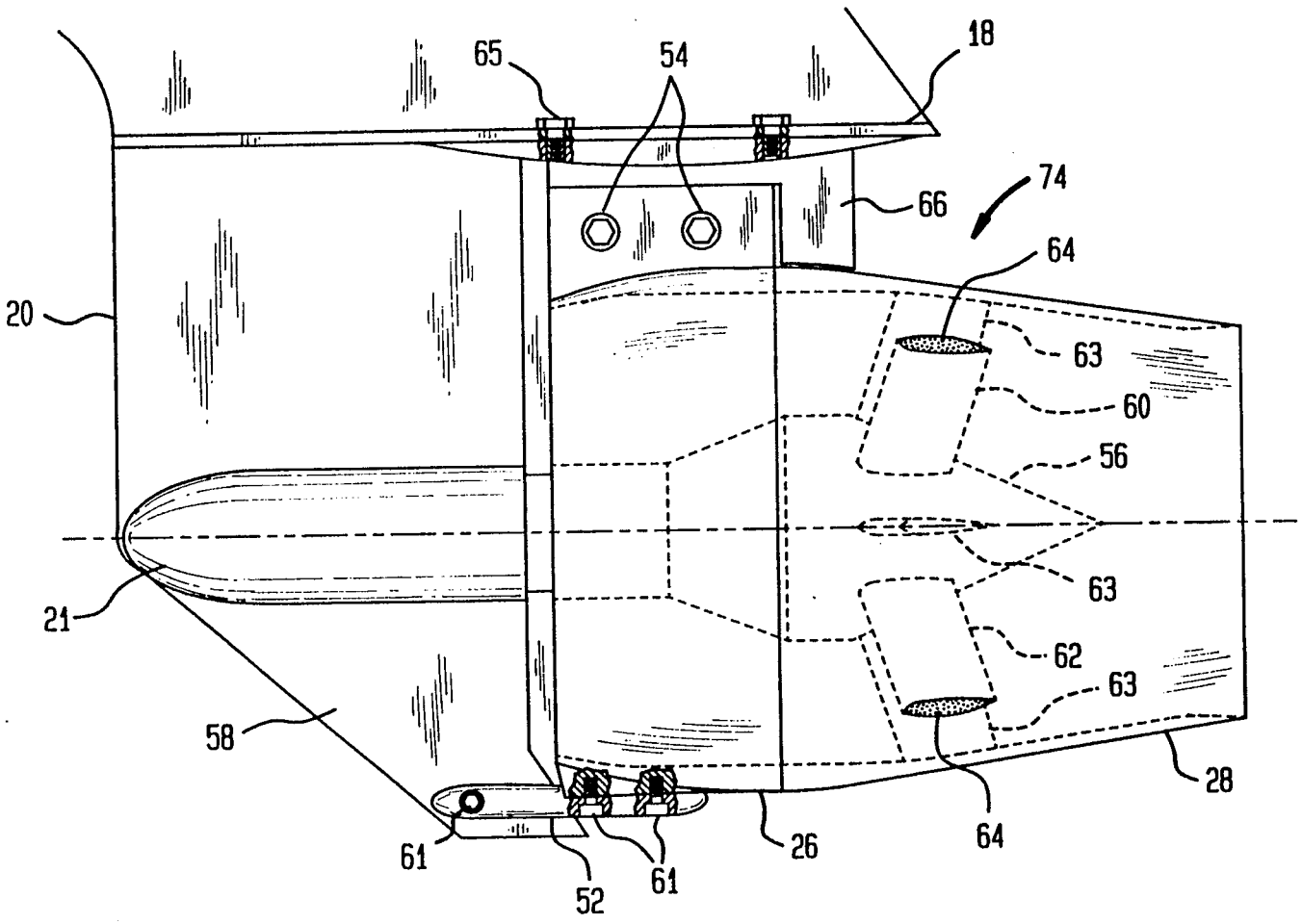
FIG. 4 is a side elevational view showing the manner of attachment of the pump jet of the present invention to a conventional outboard motor including hollow and solid stator vanes.

In another arrangement, stator vane 60 can extend at an angle of 45° either up or down within stator housing 28, as shown in FIG. 4. Stator vanes 60 and 62 direct exhaust stream 100 diagonally from the sides of the stator housing 28. One or more of stator vane 60 and 62 can be hollow and communicate with plenum cavity 44 and one or more stator vanes 63 can be solid. One or more hollow stator vanes can be provided for allowing the exhaust to be discharged radially at one or more locations on the outer surface of the stator housing, thereby providing a quiet engine exhaust signature. It will be appreciated that other locations for the stator vanes could be used in accordance with the teachings of the present invention.

During assembly of the present invention, a conventional propeller is removed from propeller shaft 22. A one-piece rotor housing assembly 70, including rotor housing 26, inlet vanes 51, and inlet vane hub 43, is joined to anticavitation plate 18 with upper bracket 66 and to skeg 58 with clamp 52. Screws 61 can be inserted through clamp 52. Screws 54 and bolts 65 attach upper bracket 66 to anticavitation plate 18. During installation inlet vane hub 43 is inserted into the downstream end of gear case 21. A one piece rotor assembly 72, composed of inner rotor hub 54, outer rotor hub 55, and rotor blades 16, is then inserted onto propeller shaft 22, and secured by nut 59. Inner rotor hub 54 is joined to outer rotor hub 55 by means of radial struts (not shown). A one-piece stator housing assembly 74 composed of stator housing 28, stator vanes 60, 62, and 63, and stator hub 56 is attached to rotor housing 26 with screws (not shown). An internal cavity in stator hub 56 forms a plenum cavity 44 through which exhaust gas is distributed to one or more hollow stator vanes 50*a*, 50*b*, 60, 62. Nut 59 extends into plenum cavity 44 in stator housing 28.

The present invention has the benefit of combining the advantages of a pump jet with an exhaust-through-the-hub motor assembly. The exhaust is channelled through a rotor hub to at least one hollow stator vane. The hollow stator vane discharges the exhaust gas to the outside of the stator housing. By discharging gas in this manner, forward and reverse thrust of the motor can be obtained by using the gears of the motor which normally control the thrust direction of the propeller. Discharging gas a substantial distance below the surface permits the pump jet to run quietly.

While the invention has been described with reference to the preferred embodiment thereof, it will be appreciated by those of ordinary skill in the art that modifications can be made to the structure and form of the invention without departing from the spirit and scope thereof.

We claim:

1. A pump jet apparatus for a marine outboard motor comprising:

a rotor hub, said rotor hub receiving exhaust from said motor;

an exhaust plenum positioned rearwardly of said rotor hub receiving exhaust from said rotor hub; and at least one hollow stator vane extending radially from said exhaust plenum, wherein said exhaust from said motor is discharged into said rotor hub and exits through said at least one stator vane.

2. The apparatus according to claim 1 wherein said rotor hub includes an annular exhaust channel having a first and second end, said first end of said channel receiving said exhaust from said motor and said second end of channel exiting into said exhaust plenum.

3. The marine apparatus according to claim 2 further comprising:

a rotor housing surrounding said rotor hub.

4. The apparatus of claim 3 further comprising:

a stator housing surrounding said exhaust plenum.

5. The apparatus according to claim 4 further comprising:

at least one port through said stator housing, said at least one stator vane having a first end positioned within said exhaust plenum and a second end connected to said port.

6. The apparatus according to claim 5 wherein said at least one stator vane extends towards the bottom surface of said stator housing.

7. The apparatus according to claim 5 wherein said stator vane extends toward the top surface of said at least one stator housing.

8. The marine apparatus according to claim 5 wherein said at least one stator vane extends diagonally through said stator housing.

9. The apparatus according to claim 5 wherein said apparatus includes two or more of said hollow stator vanes.

10. The apparatus according to claim 9 wherein said apparatus includes two or more solid stator vanes.

* * * * *